US008720688B2

(12) United States Patent
Hassell et al.

(10) Patent No.: US 8,720,688 B2
(45) **Date of Patent: *May 13, 2014**

(54) STACKING CRATES

(75) Inventors: Jon P. Hassell, Atlanta, GA (US); William P. Apps, Alpharetta, GA (US); Gerald R. Koefelda, Rowlett, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 2210 days.

This patent is subject to a terminal disclaimer.

(21) Appl. No.: 11/285,768

(22) Filed: Nov. 21, 2005

(65) Prior Publication Data

US 2006/0113210 A1 Jun. 1, 2006

Related U.S. Application Data

(63) Continuation of application No. 10/346,825, filed on Jan. 17, 2003, now Pat. No. 6,966,442.

(51) Int. Cl.
*B65D 21/032* (2006.01)

(52) U.S. Cl.
USPC ..... 206/509; 206/519; 206/518; 220/519

(58) Field of Classification Search
USPC ..... 220/509, 519, 515, 517; 206/509, 519, 206/511, 518
See application file for complete search history.

(56) References Cited

U.S. PATENT DOCUMENTS

| | | | |
|---|---|---|---|
| 2,535,493 | A | 12/1950 | Gerber |
| 3,009,579 | A | 11/1961 | Elttlinger, Jr. |
| 3,052,373 | A | 9/1962 | Frater |
| 3,245,548 | A | 4/1966 | Kesilman et al. |
| 3,265,237 | A | 8/1966 | Pache et al. |
| 3,270,913 | A | 9/1966 | Bridenstine et al. |
| 3,332,574 | A | 7/1967 | Earp |
| 3,349,943 | A | 10/1967 | Box |
| D224,366 | S | 7/1972 | Rehrig |
| 3,744,707 | A | 7/1973 | Ross |
| 3,794,208 | A | 2/1974 | Roush et al. |
| 3,997,057 | A | 12/1976 | Craig |
| 4,011,948 | A | 3/1977 | Rehrig et al. |
| D244,486 | S | 5/1977 | Johnson et al. |
| D247,648 | S | 3/1978 | Carroll et al. |
| 4,095,720 | A | 6/1978 | Delbrouck et al. |

(Continued)

FOREIGN PATENT DOCUMENTS

| | | |
|---|---|---|
| DE | 28 01 077 A1 | 7/1978 |
| DE | 27 12 748 A1 | 9/1978 |

(Continued)

OTHER PUBLICATIONS

Photos of Norseman Plastics Ltd crate, dated Jan. 2002.

(Continued)

*Primary Examiner* — Stephen Castellano
(74) *Attorney, Agent, or Firm* — Carlson, Gaskey & Old

(57) ABSTRACT

A stacking crate for bottles has a plurality of tapered pylons extending upward from a periphery of a floor. A rib extends downwardly in the interior of a cavity in each pylon. Each pylon further includes a slot in an upper surface of the pylon substantially aligned with the rib. When similar crates are nested, the ribs in the pylons of one crate will rest in the slots in the upper surface of the pylons of the lower crate, thus permitting the crates to be nested.

26 Claims, 9 Drawing Sheets

(56) References Cited

U.S. PATENT DOCUMENTS

| | | | |
|---|---|---|---|
| 4,101,049 | A | 7/1978 | Wallace et al. |
| 4,105,117 | A | 8/1978 | Atkin et al. |
| 4,143,764 | A | 3/1979 | Moss, III |
| 4,256,224 | A | 3/1981 | Hirota |
| 4,319,685 | A | 3/1982 | David |
| 4,410,099 | A | 10/1983 | deLarosiere |
| 4,759,451 | A | 7/1988 | Apps |
| 4,773,554 | A | 9/1988 | Warwick |
| 4,846,365 | A | 7/1989 | Steinlein |
| 4,899,874 | A | 2/1990 | Apps et al. |
| 4,928,841 | A | 5/1990 | Arthurs |
| 4,932,532 | A | 6/1990 | Apps et al. |
| 4,944,400 | A | 7/1990 | Van Onstein et al. |
| 4,978,002 | A | 12/1990 | Apps et al. |
| 5,031,761 | A | 7/1991 | de Larosiere |
| 5,060,819 | A | 10/1991 | Apps |
| 5,096,085 | A | 3/1992 | Eek et al. |
| 5,097,980 | A | 3/1992 | Warwick |
| D325,279 | S | 4/1992 | Apps |
| 5,105,948 | A | 4/1992 | Morris et al. |
| D329,931 | S | 9/1992 | Apps |
| D330,621 | S | 10/1992 | Apps |
| 5,213,211 | A | 5/1993 | Umiker |
| 5,335,814 | A | 8/1994 | Hepp |
| 5,426,890 | A | 6/1995 | Dümmen |
| D361,431 | S | 8/1995 | Koefelda |
| 5,445,273 | A | 8/1995 | Apps |
| 5,465,843 | A | 11/1995 | Koefelda |
| 5,487,487 | A | 1/1996 | Hammett |
| D371,239 | S | 7/1996 | Kelly |
| D378,249 | S | 3/1997 | Apps et al. |
| D379,121 | S | 5/1997 | Apps et al. |
| D379,717 | S | 6/1997 | Apps et al. |
| D380,613 | S | 7/1997 | Apps et al. |
| D380,901 | S | 7/1997 | Apps et al. |
| 5,651,461 | A | 7/1997 | Koefelda |
| 5,660,279 | A | 8/1997 | Apps et al. |
| 5,704,482 | A | 1/1998 | Apps et al. |
| 5,752,602 | A | 5/1998 | Ackermann et al. |
| D398,152 | S | 9/1998 | Kelly |
| D399,060 | S | 10/1998 | Apps et al. |
| D399,061 | S | 10/1998 | Apps et al. |
| D400,012 | S | 10/1998 | Apps |
| D401,764 | S | 12/1998 | Apps et al. |
| 5,842,572 | A | 12/1998 | Apps et al. |
| D404,204 | S | 1/1999 | Apps |
| 5,855,277 | A | 1/1999 | Apps et al. |
| 5,913,424 | A | 6/1999 | Kelly et al. |
| 5,918,751 | A | 7/1999 | Kelly |
| D412,399 | S | 8/1999 | Apps et al. |
| 5,979,654 | A | 11/1999 | Apps |
| 6,006,912 | A | 12/1999 | McGrath |
| 6,047,844 | A | 4/2000 | McGrath |
| 6,073,793 | A | 6/2000 | Apps et al. |
| D441,957 | S | 5/2001 | Kelly |
| 6,237,758 | B1 | 5/2001 | Hsu |
| D462,522 | S | 9/2002 | Apps et al. |
| 6,457,599 | B1 | 10/2002 | Apps et al. |
| D465,417 | S | 11/2002 | Apps |
| D466,018 | S | 11/2002 | Apps |
| D468,634 | S | 1/2003 | Hammett |
| 6,749,065 | B1 | 6/2004 | Hammett |
| 6,899,247 | B1 | 5/2005 | Koefelda et al. |
| 6,966,442 | B2 | 11/2005 | Hassell et al. |

FOREIGN PATENT DOCUMENTS

| | | | |
|---|---|---|---|
| EP | 0 231 008 | A2 | 1/1987 |
| FR | 1351218 | | 12/1963 |
| FR | 2 698 610 | A1 | 6/1994 |
| IT | 725683 | | 11/1966 |
| WO | WO 89/03737 | A1 | 5/1989 |
| WO | 94/10053 | | 5/1994 |
| WO | WO 00/75027 | A1 | 12/2000 |
| WO | WO 01/02261 | A1 | 1/2001 |
| WO | WO 02/10023 | A1 | 2/2002 |

OTHER PUBLICATIONS

Arbitration Brief of Norseman Plastics Limited on Invalidity of U.S. Patent Nos. 6,899,247 and 6,966,442, Nov. 12, 2008.

Norseman's Reply Brief Regarding Invalidity, Jan. 12, 2009.

Declaration of Roger Nolan in Support of Norseman's Contention that U.S. Patent Nos. 6,996,442 and 6,899,247 are Invalid, Nov. 12, 2009.

Rehrig's Arbitration Brief, Group B—Validity.

Rehrig's Reply Brief, Group B—Validity.

Declaration and Expert Report of William Patrick Apps, Dec. 22, 2008.

Invalidity Claim Chart for U.S. Patent Nos. 6,966,442 and 6,899,247.

Partial Award of Arbitrators, Mar. 12, 2009.

STACKING CRATES

CROSS-REFERENCE TO RELATED APPLICATION

This application is a continuation of application U.S. Ser. No. 10/346,825, filed on Jan. 17, 2003, now U.S. Pat. No. 6,966,442.

TECHNICAL FIELD

The present invention relates to a manner of stacking crates, in particular nestable display crates for transporting and storing containers.

BACKGROUND OF THE INVENTION

Bottles, particularly those for soft drinks and other beverages, are often stored and transported during the distribution stages in crates or trays. The term "crate" or "tray" as used herein includes crates, trays and similar containers having a bottom and peripheral side wall structure. These crates are generally configured to be stacked on top of each other loaded with bottles, and nested together when empty.

In order to minimize the storage space of the crates while nested and to reduce cost and waste, many crates today are made with a shallow peripheral side wall structure. These generally are referred to as "low depth" crates in which the bottles bear most of the load of above-stacked crates. Crates having a higher peripheral side wall, approximately the same height as the bottles, generally are referred to as "full depth" crates in which the crates themselves bear most of the load of above-stacked crates.

The assignee of the present invention has previously provided the low depth, nestable display crate 100 shown in FIG. 10 herein. The nestable display crate 100 has a floor 102 and a wall structure 104. The wall structure 104 comprises a lower wall portion 106 and a plurality of integrally formed pylons 108 arranged around the periphery of the crate 100. The pylons 108 are hollow and tapered so that pylons 108 of empty crates 100 can nest within one another. Handles 110 are integrally formed to extend between some of the pylons 108. Inside each hollow pylon 108 a rib 112 extends downwardly. When nested, each rib 112 will rest upon an upper surface of a corresponding pylon 108 of the below nested crate 100. The rib 112 prevents the pylons 108 from being wedged too tightly within one another. This crate 100 is described and claimed in commonly assigned U.S. Pat. No. 5,855,277 that is hereby incorporated by reference in its entirety. Commonly assigned U.S. Pat. No. 5,465,843 is also incorporated by reference in its entirety.

SUMMARY OF THE INVENTION

The present invention provides a nestable display crate that provides pylons having a different size (preferably taller) than the predecessor crate while maintaining nesting compatibility with the predecessor crates. Taller pylons are sometimes preferred for increased stability of the bottles in the crate and for increased stability of stacked crates of bottles, particularly with taller bottles.

Because pylons of the present crate are taller than the pylons of the predecessor crate, each pylon includes a slot in its upper surface substantially aligned with the rib in the pylon. In one embodiment, the depth of the slot is substantially equal to the height difference between the pylons in the crate of the present invention and the pylons in the predecessor crate. As a result, when one of the crates of the present invention is nested within one of the predecessor crates, the rib inside each pylon of the predecessor crate will be received within the slot of the upper surface of each pylon in the crate of the present invention, thus permitting the present crate and the predecessor crates to fully nest, thus reducing stacking height. At the same time, the taller pylons in the crate of the present invention provide increased stability of the bottles in the crate and increased stability of stacked crates of bottles.

In another feature of the crate of the present invention, each handle of the crate is provided at a height substantially equal to the lower surface of the slots in the pylons. This permits automated handling equipment configured for the predecessor crates 100 to operate on the present crate without modification.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

Other advantages of the present invention will be readily appreciated as the same becomes better understood with reference to the following detailed description when considered in connection with the accompanying drawings wherein.

All of the drawings in the present application are to scale.

DETAILED DESCRIPTION OF THE PREFERRED EMBODIMENT

Figure 1:
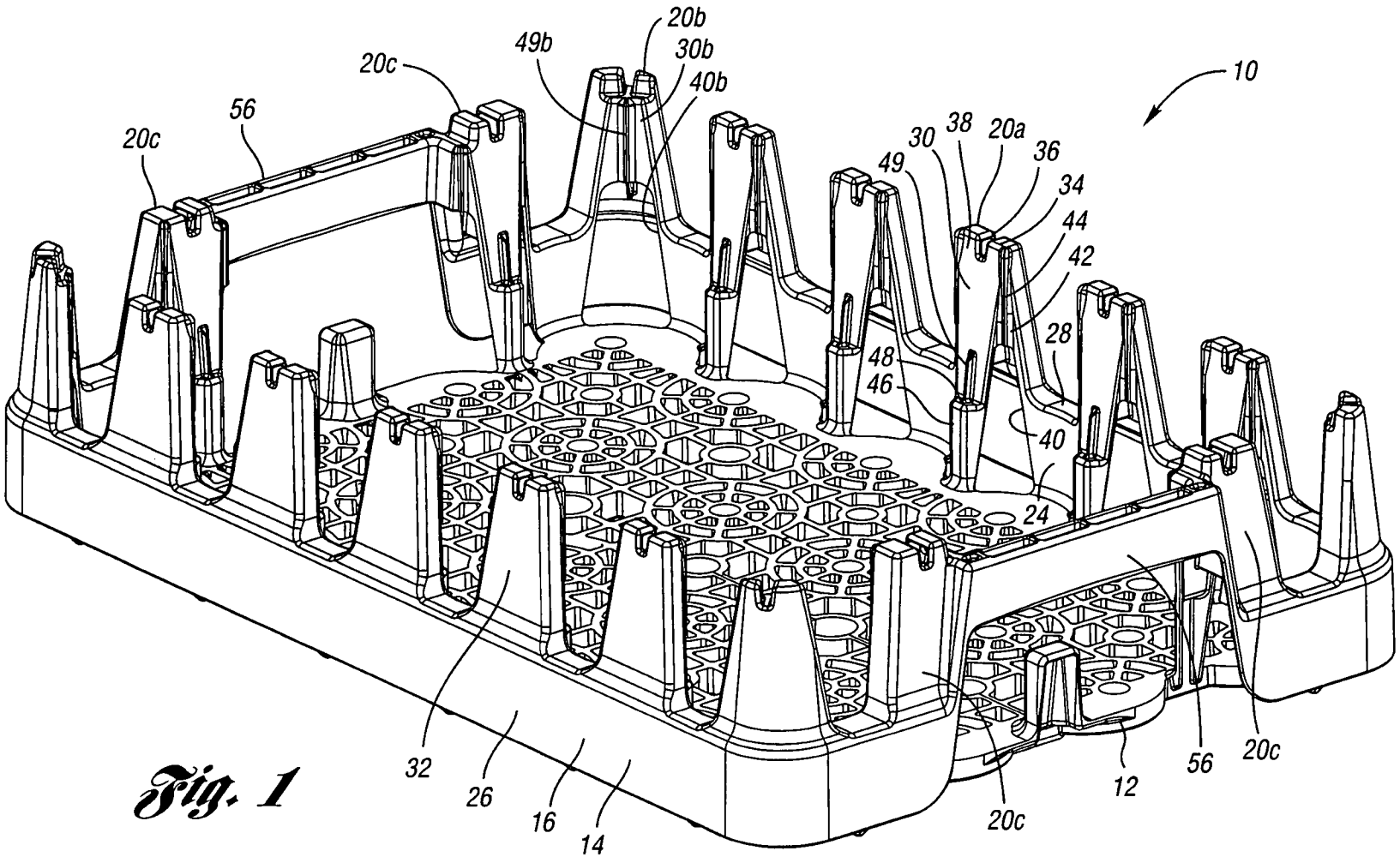
FIG. 1 is a perspective view of a nestable crate according to the present invention.

A nestable display crate 10 according to the present invention is illustrated in FIG. 1. The nestable display crate 10 generally comprises a floor 12 and a wall 14 extending upwardly from the periphery of the floor 12. The wall 14 comprises a lower wall portion 16 and a plurality of pylons 20, including side pylons 20*a*, corner pylons 20*b*, and end pylons 20*c* (generically "pylons 20"). The lower wall portion 16 includes an inner surface 24 and an outer surface 26 joined by an upper surface 28.

Similarly, the pylons each comprise an inner wall 30 and an outer wall 32 joined by an upper surface 34. As can be seen in FIG. 1, each pylon 20 includes a slot 36 in the upper surface 34 extending through the inner wall 30 and the outer wall 32. The inner wall 30 comprises a front panel section 38 disposed between openings 40 formed in each of two angled panel sections 42. Front panel section 38 extends from the upper surface 34 at a slight angle toward the floor 12. A label surface contact rib 44 projects from each angled panel section 42. Contact ribs 44 accommodate the step (or smaller effective diameter) formed in the label area of a standard soda bottle, in order to provide support thereto. The front panel section 38 further includes a projection 46 adjacent the floor 12 forming an upper ledge 48. A small rib 49 extends upwardly from the ledge 48 along the front panel section 38.

Each corner pylon 20*b* includes an inner wall portion 30*b* having a label surface contact rib 49*b* and disposed above an aperture 40*b*. A handle 56 extends horizontally, generally parallel to the floor 12 between end pylons 20*c*.

Figure 2:
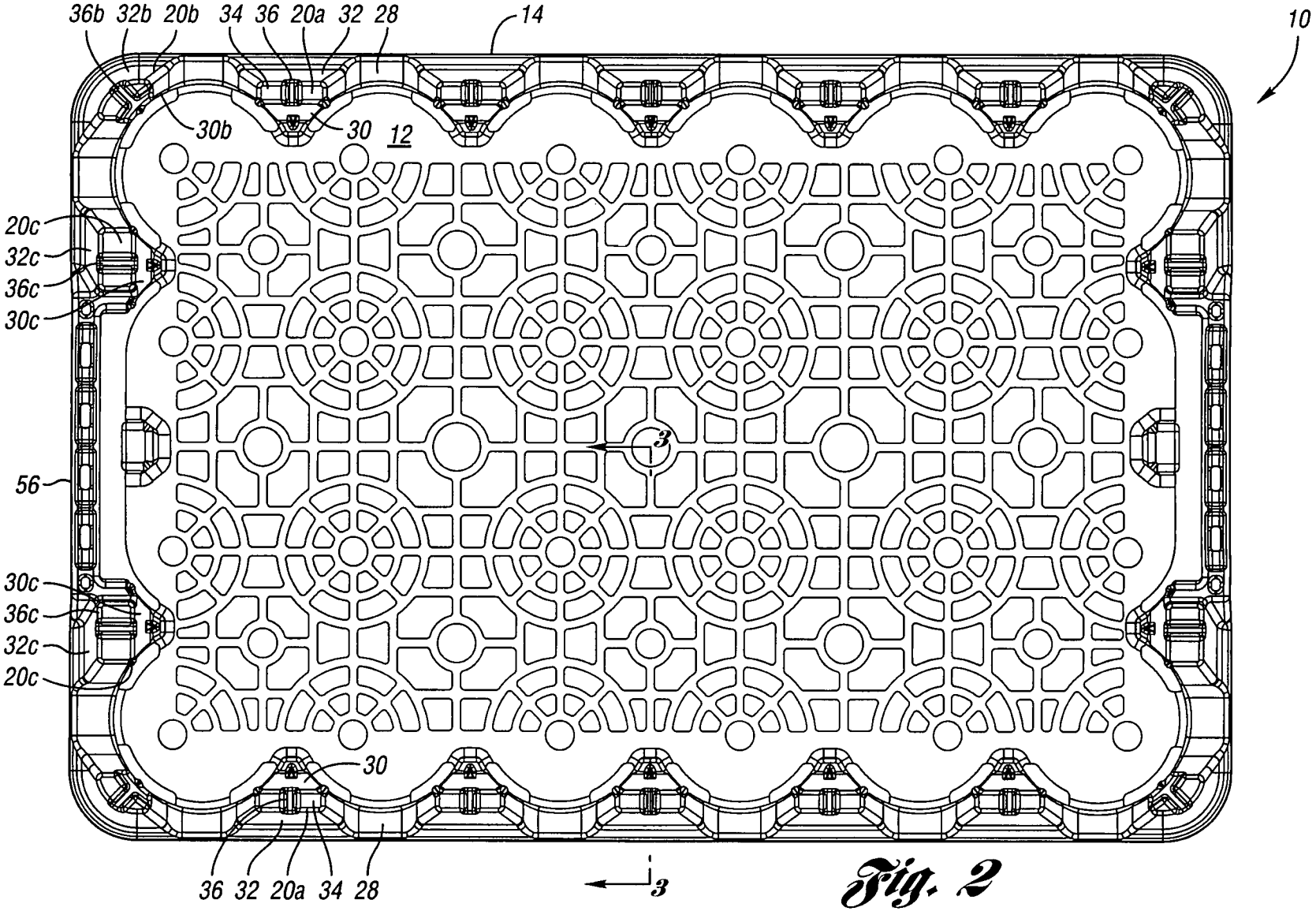
FIG. 2 is a top view of the nestable crate of FIG. 1.

FIG. 2 is a top view of the crate of FIG. 1. As can be seen in FIG. 2, a plurality of pylons 20 are disposed about the periphery of the floor 12. As also shown in FIG. 2, the slot 36 in the upper surface 34 of the pylon 20*a* extends transversely to the inner wall 30 and outer wall 32 and extends through the inner wall 30 and outer wall 32. Similarly, the slot 36*b* extends transversely through the inner wall 30*b* and outer wall 32*b* of the corner pylon 20*b*. Also, the slot 36*c* extends transversely through the inner wall 30*c* and outer wall 32*c* of the end pylon 20*c*.

Figure 3:
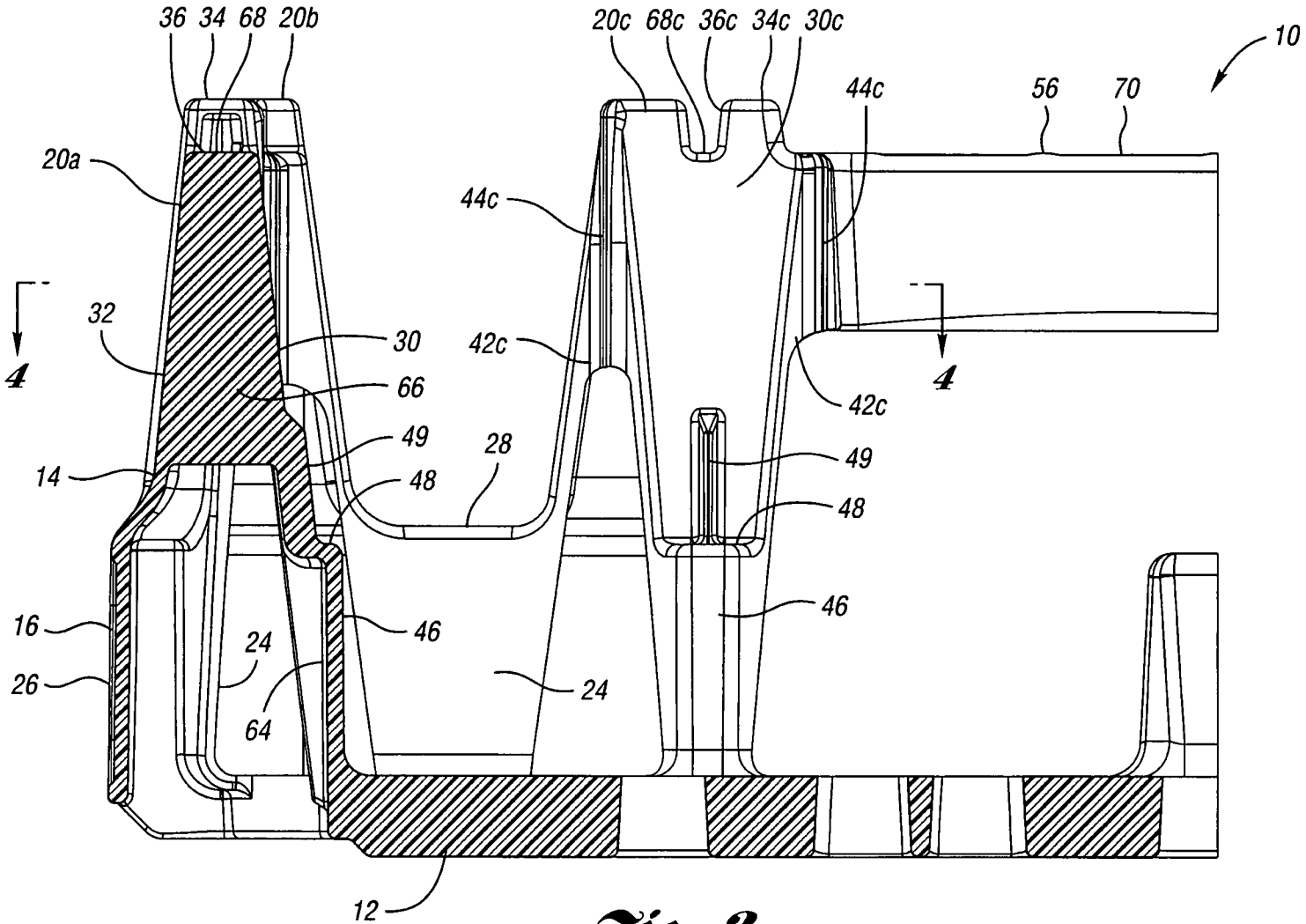
FIG. 3 is a sectional view taken along line 3-3 of FIG. 2.

FIG. 3 is a sectional view along lines 3-3 of FIG. 2—through the slot 36 in the pylon 20. Referring to FIG. 3, the pylons 20 are generally hollow and define a cavity 64 generally between the outer wall 26 of the lower wall portion 16 together with the outer wall 32 of the pylon 20 on one side, and the inner wall 30 of the pylon 20 on the other. A rib 66 extending downward roughly halfway into the cavity 64 is substantially aligned with the slot 36 below which it extends.

The outer wall 26 of the lower wall portion 16 is substantially perpendicular to the floor 12. The outer wall 32 of the pylon 20 is offset inward of the outer wall 26 of the lower portion 16 and is slightly angled more than the outer surface 26 of the lower wall portion 16.

An upper surface 70 of each handle 56 is preferably substantially the same height as the rib support surfaces 68, 68*c* and 68*b* (not shown). As shown in FIG. 3, the upper surface 70 of each handle 56 is most preferably the same height as all of the rib support surfaces 68.

Figure 4:
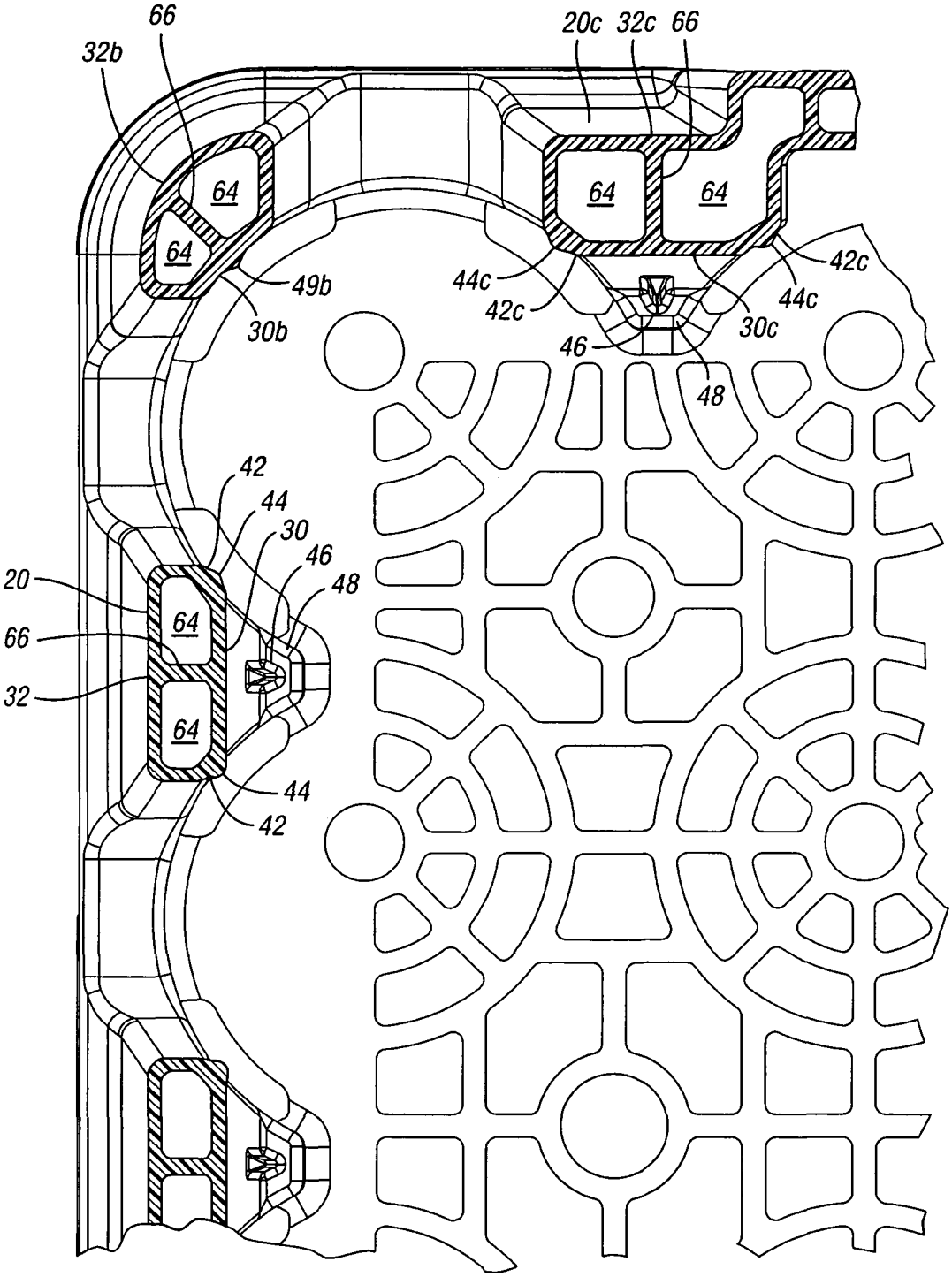
FIG. 4 is a sectional view taken along lines 4-4 of FIG. 3.

FIG. 4 is a sectional view taken along lines 4-4 of FIG. 3. As can be seen in FIG. 4, the ribs 66 extend generally transversely to, and are integral with, the inner wall 30 and outer wall 32 of each of the pylons 20. The ribs 66 generally bisect the cavities 64 of the pylons 20.

Figure 10:
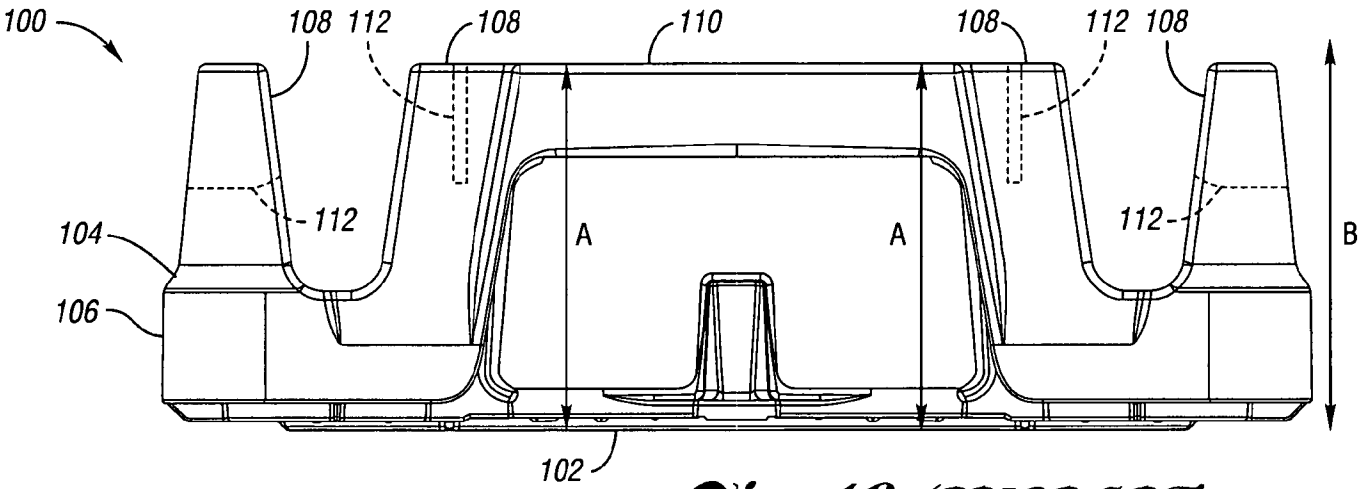
Fig. 10 (PRIOR ART)
FIG. 10 is an end view of a prior art, predecessor nestable crate.
Figure 5:
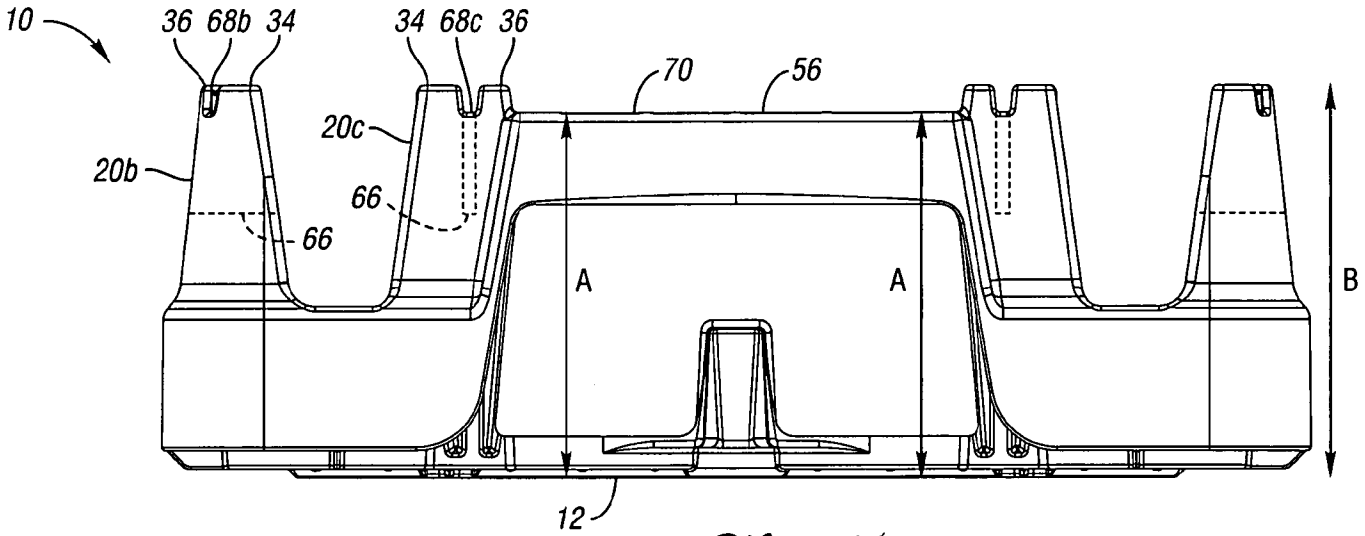
FIG. 5 is an end view of the crate.

FIG. 5 is an end view of the crate 10 illustrating some dimensional relationships to the predecessor crate 100 of FIG. 10. First, the dimension A from the bottom surface of floor 12 to the upper surface 70 of the handle 56 in FIG. 5 is equal to the distance A from the bottom surface of floor 102 to the upper surface of handle 110 and the upper surface of the pylons 108 in the predecessor crate 100 of FIG. 10. Similarly, as explained above, this is also equal (or preferably, at least substantially equal) to the distance from the bottom surface of floor 12 to the rib support surface 68 at the bottom of each slot 36 in all of the pylons 20 of the present crate 10 in FIG. 5.

Additionally, in FIG. 5 the overall height B from the bottom surface of the floor 12 to the upper surface 34 of each of the pylons 20 is greater than the distance A, such that the pylons 20 in the present crate 10 are taller than those in the predecessor crate 100. Further, the length that the ribs 68 extend downwardly from the rib support surface 68 of the slot 36 is equal to the length that the ribs 112 extend downwardly from the upper surface of the pylons 108 in the predecessor crate 100 of FIG. 10.

Figure 6:
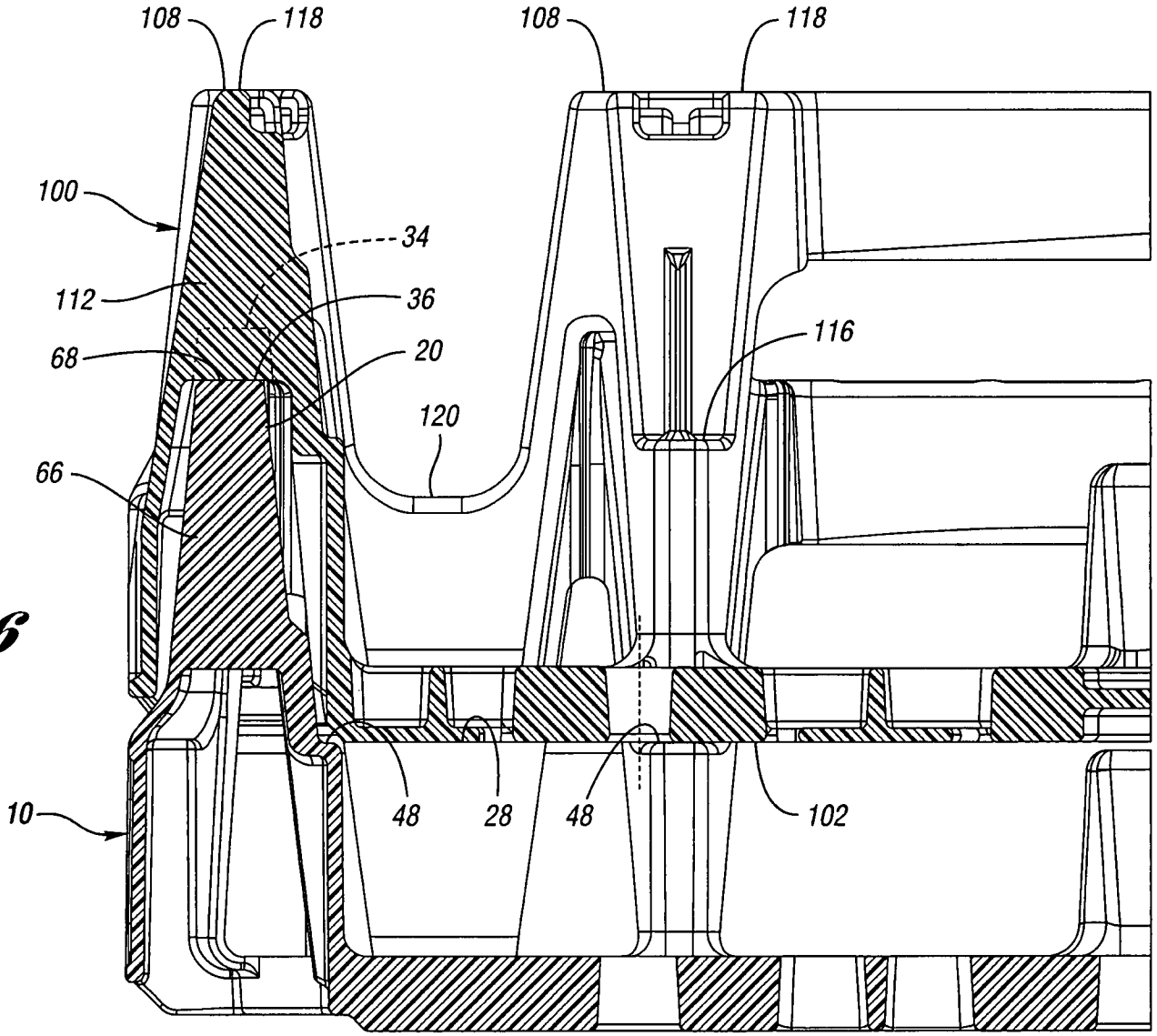
FIG. 6 is a sectional view of the nestable crate of FIGS. 1-5 nested within a predecessor prior art crate of FIG. 10.

As a result, the crate 10 of the present invention provides higher pylons 20, which increases bottle stability and the stability of stacked crates of bottles while still being fully nestable within the predecessor crates 100. This is demonstrated in FIG. 6. FIG. 6 is a sectional view, similar to that of FIG. 3, through the crate 10 of the present invention nested in the predecessor crate 100. As shown, the ribs 112 of the pylons 108 are received within the slots 36 through upper surface 34 of each of the pylons 20 in crate 10, such that the ribs 112 rest on rib support surfaces 68. In the embodiment shown, a distance from a ledge 116 to an upper surface 118 of each pylon 108 in the predecessor crate 100 is approximately the same as a distance from the ledge 48 to the lower surface 68 of the slot 36 of the crate 10.

The pylons 20 are thus able to fully nest within the cavities of the pylons 108 of the predecessor crate 100, despite the increased height of the pylons 20.

Additionally, the floor 102 of the predecessor crate 100 rests on the ledge 48 of the present crate 10 and the overall height of the two stacked crates 10, 100 is minimized. Because the height of the handle 56 is the same as that of the handle 110 of the predecessor crate 100, automated handling equipment configured for the predecessor crates 100 will be able to operate on the present crate 10 without modification. Additionally, although not illustrated here, it should be recognized that the predecessor crate 100 can fully nest within the present crate 10.

Figure 7:
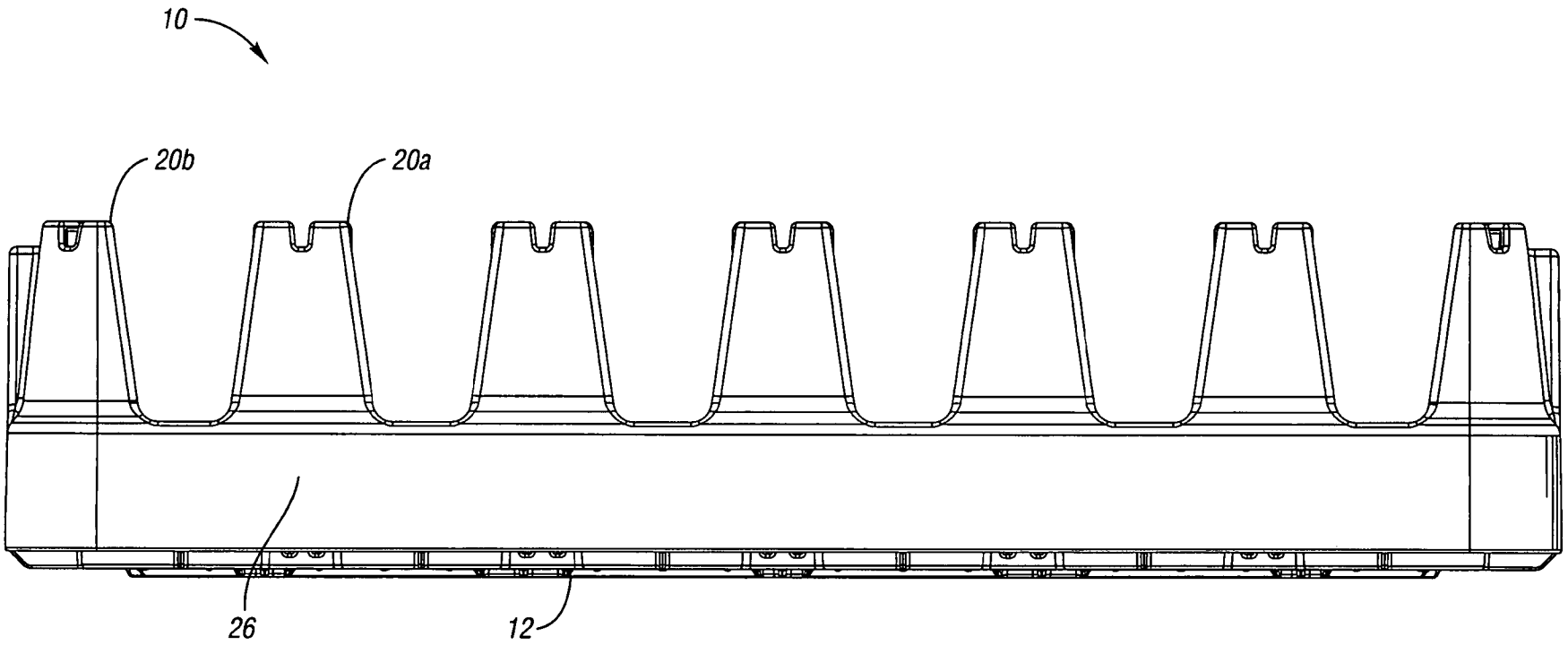
FIG. 7 is a side view of the nestable crate of FIG. 1.
Figure 8:
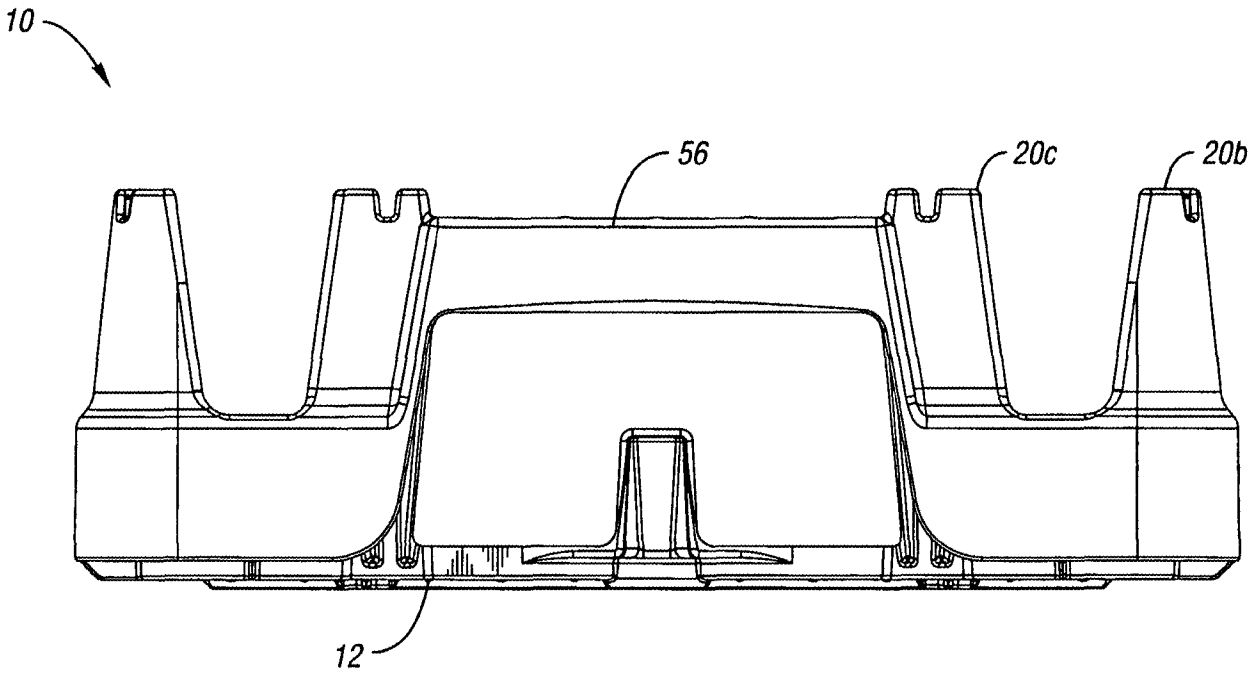
FIG. 8 is an end view of the nestable crate of FIG. 1.
Figure 9:
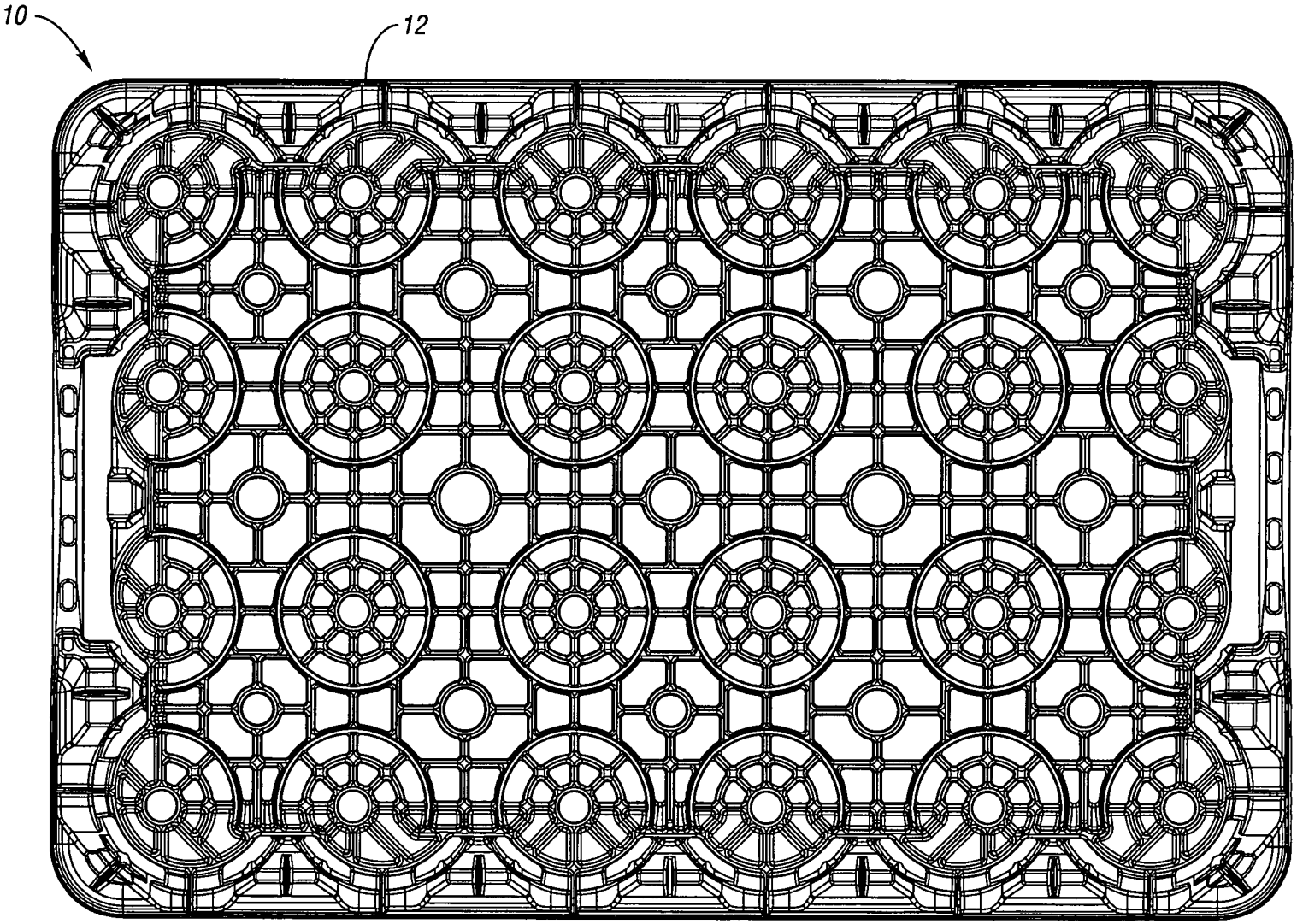
FIG. 9 is a bottom view of the nestable crate of FIG. 1.

FIG. 7 is a side view of the crate 10 of the present invention. FIG. 8 is an end view of crate 10 of the present invention. FIG. 9 is a bottom view of the crate 10 of the present invention.

The nestable crate 10 of the present invention is preferably formed in one piece of high density polyethylene via an injection molding process, but of course can be formed of any type of plastic applicable for the desired use. While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for nestable crates and many variations in design, many of which would benefit from the present invention.

What is claimed is:

1. A crate for containers comprising:

a floor;

a lower wall portion extending upward from the floor;

a plurality of tapered pylons about a periphery of the floor and extending upward from the floor beyond an upper surface of the lower wall portion, each pylon defining a cavity between an inner wall and an outer wall, each pylon including a rib transverse to the inner wall and the outer wall in the cavity, a lowermost edge of the rib spaced above a plane defined by the upper surface of the lower wall portion, each pylon further including a slot in an upper surface of the pylon through the inner wall and the outer wall, the slot defined by a bottom surface and opposed side walls connecting the inner wall to the outer wall, the slot substantially aligned with the rib; and at least one handle extending generally parallel to the floor, each of the at least one handle including an upper surface generally the same height as the bottom surface of each slot.

2. The crate of claim 1 wherein the lower wall portion includes an inner wall and an outer wall joined by the upper surface of the lower wall portion, the inner wall and outer wall of the pylons joined by the upper surface of each pylon to define the cavity.

3. The crate of claim 2 wherein the rib and the slot extend generally transversely to the inner wall and outer wall of each pylon.

4. The crate of claim 2 wherein the inner wall of the pylon includes a front panel section extending from the upper surface of the pylon to the floor between two apertures.

5. The crate of claim 4 wherein the inner wall of the pylon further includes an angled panel section between each aperture and the upper surface, each angled panel section including a projection from an inner surface of the angled panel section.

6. The crate of claim 1 wherein the at least one handle extends between two of the plurality of pylons.

7. A pair of nested crates of which the crate of claim 1 is a first crate and further including a second crate having a floor and a plurality of tapered pylons extending upward from the periphery of the floor and defining a cavity having a rib extending therein, the first crate nested at least partially within the second crate such that the pylons of the first crate are at least partially disposed within pylons of the second crate with the ribs of the second crate at least partially disposed within the slots of the first crate.

8. The pair of nested crates of claim 7 wherein the first crate and the second crate each include a ledge on an inner surface of each pylon, a distance from the ledge in the second crate to the upper surface of each pylon in the second crate being approximately the same as a distance from the ledge of the first crate to a lower surface of the slot of the first crate.

9. The crate of claim 1 wherein the floor is contained within the lower wall portion and is substantially planar.

10. The crate of claim 1 including an aperture located between adjacent pylons on one side of the at least one handle and another aperture located between adjacent pylons on the other side of the at least one handle.

11. The crate of claim 1 wherein the lower wall portion includes an outer wall joined to the upper surface of the lower wall portion, and the outer wall of the pylons is joined to the upper surface of each pylon to define the cavity.

12. The crate of claim 1 wherein the pylons include a first pylon and a second pylon, and the at least one handle extends between an inner surface of the first pylon and an opposing inner surface of the second pylon that faces the inner surface of the first pylon.

13. The crate of claim 12 wherein the at least one handle contacts the inner surface of the first pylon and the opposing inner surface of the second pylon.

14. A crate for containers comprising:

a floor;

a lower wall portion extending upward from the floor;

a plurality of tapered pylons about a periphery of the floor and extending upward from the floor beyond an upper surface of the lower wall portion, each pylon defining a cavity between an inner wall and an outer wall, each pylon including a rib transverse to the inner wall and the outer wall in the cavity, a lowermost edge of the rib spaced above a plane defined by the upper surface of the lower wall portion, each pylon further including a slot in an upper surface of the pylon through the inner wall and the outer wall, the slot defined by a bottom surface and opposed side walls connecting the inner wall to the outer wall, the slot substantially aligned with the rib; and at least one handle extending between two of the plurality of pylons, wherein the at least one handle includes an upper surface that is located below the upper surface of the pylons, the pylons include a first pylon and a second pylon, and the at least one handle extends between an inner surface of the first pylon and an opposing inner surface of the second pylon that faces the inner surface of the first pylon.

15. The crate of claim 14 wherein the lower wall portion includes an inner wall and an outer wall joined by the upper surface of the lower wall portion, the inner wall and outer wall of the pylons joined by the upper surface of each pylon to define the cavity.

16. The crate of claim 15 wherein the rib and the slot extend generally transversely to the inner wall and outer wall of each pylon.

17. The crate of claim 15 wherein the inner wall of the pylon includes a front panel section extending from the upper surface of the pylon to the floor between two apertures.

18. The crate of claim 17 wherein the inner wall of the pylon further includes an angled panel section between each aperture and the upper surface, each angled panel section including a projection from an inner surface of the angled panel section.

19. A pair of nested crates of which the crate of claim 14 is a first crate and further including a second crate having a floor and a plurality of tapered pylons extending upward from the periphery of the floor and defining a cavity having a rib extending therein, the first crate nested at least partially within the second crate such that the pylons of the first crate are at least partially disposed within pylons of the second crate with the ribs of the second crate at least partially disposed within the slots of the first crate.

20. The pair of nested crates of claim 19 wherein the first crate and the second crate each include a ledge on an inner surface of each pylon, a distance from the ledge in the second crate to the upper surface of each pylon in the second crate being approximately the same as a distance from the ledge of the first crate to a lower surface of the slot of the first crate.

21. The crate of claim 14 wherein the floor is contained within the lower wall portion and is substantially planar.

22. The crate of claim 14 including an aperture located between adjacent pylons on one side of the at least one handle and another aperture located between adjacent pylons on the other side of the at least one handle.

23. The crate of claim 14 wherein the lower wall portion includes an outer wall joined to the upper surface of the lower wall portion, the outer wall of the pylons is joined to the upper surface of each pylon to define the cavity.

24. The crate of claim 14 wherein the upper surface of the at least one handle is located between a plane defined by the upper surface of the pylons and a plane defined by the floor.

25. The crate of claim 14 wherein the at least one handle contacts the inner surface of the first pylon and the opposing inner surface of the second pylon.

26. A crate for containers comprising:

a floor;

a lower wall portion extending upward from the floor;

a plurality of tapered pylons about a periphery of the floor and extending upward from the floor beyond an upper surface of the lower wall portion, each pylon defining a cavity between an inner wall and an outer wall, each pylon including a rib transverse to the inner wall and the outer wall in the cavity, a lowermost edge of the rib spaced above a plane defined by the upper surface of the lower wall portion, each pylon further including a slot in an upper surface of the pylon through the inner wall and the outer wall, the slot defined by a bottom surface and opposed side walls connecting the inner wall to the outer wall, the slot substantially aligned with the rib; and at least one handle extending between two of the plurality of pylons, wherein the at least one handle extends generally parallel to the floor, and each of the at least one handle includes an upper surface generally the same height as the bottom surface of each slot.

* * * * *